US005413340A

United States Patent [19]

Potvin et al.

[11] Patent Number: 5,413,340

[45] Date of Patent: May 9, 1995

[54] ADJUSTABLE GOAL FRAME

[76] Inventors: Denis C. Potvin, 8 Saddle Ridge Rd., Pound Ridge, N.Y. 10576; Daniel Lilie, 176 W. 86th St., New York, N.Y. 10024

[21] Appl. No.: 104,183

[22] Filed: Aug. 9, 1993

[51] Int. Cl.[6] ..... A63B 63/02

[52] U.S. Cl. ..... 273/127 B; 273/400

[58] Field of Search ..... 273/127 R, 127 B, 57.2, 273/398, 400, 401, 410, 411

[56] References Cited

U.S. PATENT DOCUMENTS 3,856,298 12/1974 Frantti ..... 273/127 R
4,339,132 7/1982 Stevens et al. ..... 273/127 B X
4,702,478 10/1987 Kruse ..... 273/127 B
4,921,257 5/1990 Heller ..... 273/401
5,080,375 1/1992 Moosavi ..... 273/400

FOREIGN PATENT DOCUMENTS 945760 1/1964 United Kingdom ..... 273/127 R

*Primary Examiner*—Raleigh W. Chiu

[57] ABSTRACT

An adjustable frame for a goal assembly for sports such as soccer, lacrosse and ice and street hockey. The dimensions of the goal assembly's frame can be adjusted to alter the vertical and horizontal dimensions of the goal's entrance. The goal's entrance can be adjusted to comprise substantially less area than the regulation or customary area of the entrance to allow players to simulate the presence of a goalie when one is not available.

9 Claims, 8 Drawing Sheets

ADJUSTABLE GOAL FRAME

FIELD OF THE INVENTION

The invention is directed to an adjustable frame for a netted goal assembly. The adjustable frame permits athletes to use the frame for competition or to hone their shooting skills by lessening the area of the goal's entrance from the regulation or customary size of the opening.

BACKGROUND OF THE INVENTION

A variety of sports require the use of a netted goal at one or both ends of a playing surface. Such sports include ice hockey, soccer, lacrosse, and roller and street hockey. In the practice of such sports, at least one player is generally designated as a goal tender (or "goalie"). The other players scrimmage while the designated goalie attempts to block shots taken at the goal.

In practice sessions or games involving relatively few players, it can be inconvenient to designate someone as goalie. Younger players, for instance, often prefer not to take the position of goalie. If only a few players are available, designating a person as goalie may leave necessary positions vacant. In the case where two players play "one-on-one", the goalie position is obviously left open. When the goalie position is left vacant, making shots can become too easy. In the case of hockey or soccer, even shots of considerable distance are much less difficult without a goalie.

The present invention permits athletes to adjust the size of the goal's entrance. By adjusting the height or width of the goal's entrance, the athlete can practice shooting into a goal having an entrance which is much smaller that regulation size. A sufficiently small entrance can effectively simulate the presence of a goalie.

The prior art discloses foldable goal assemblies but not goal structures which can be adjusted to vary the dimensions of the goal's entrance. U.S. Pat. No. 3,642,282 discloses a foldable goal which can be collapsed to an easily storable structure. The patent discloses that the front side bars can telescope to reduce the size of the goal, but this is merely in the context of collapsing the entire unit for storage. The patent disloses that the rear central support member does not telescope or otherwise change in length, so the frame, once constructed, cannot be adjusted to reduce the goal's entrance and also remain upright or stable.

U.S. Pat. Nos. 3,501,150 and 3,698,715 disclose a collapsible hockey goal which can be folded into a compact unit. The patents do not disclose a goal which can be adjusted to provide a range of dimensions for the goal's entrance.

U.S. Pat. No. 3,204,966 discloses a goal assembly which can be adjusted to make scoring more or less difficult. Rather than alter the size of the goal's opening, the patent discloses placing a back board within the goal which is varied in shape. The difficulty in scoring can be varied by, for instance, including a rule in the game that to score a puck or ball must pass through a cut-out in the back board. Thus, unlike the present invention, scoring is made more difficult by adjusting a structure within the goal rather than the dimensions of the goal's entrance.

SUMMARY OF THE INVENTION

The present invention comprises an adjustable frame for a goal assembly for sports such as soccer, lacrosse and ice and street hockey. The dimensions of the goal assembly's frame can be adjusted to alter the size of the goal's entrance. The goal's entrance can be adjusted to comprise substantially less area than the regulation or customary area of the entrance to allow players to simulate the presence of a goalie when one is not available.

DETAILED DESCRIPTION OF THE INVENTION

Figure 1:
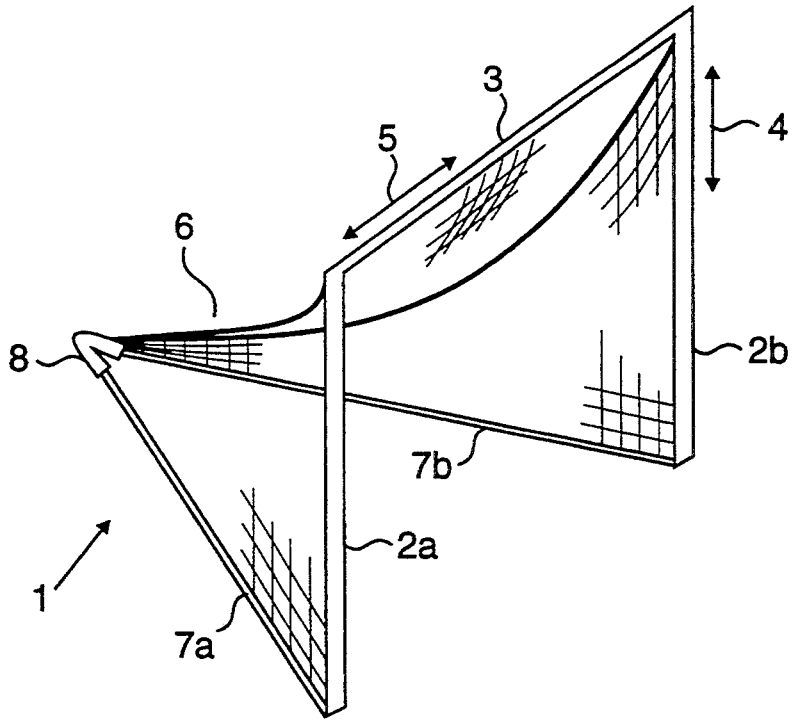
FIG. 1 is a perspective view of a goal assembly having the features of the present invention.

The goal frame of the present invention can be adjusted to vary the height and width of the goal's entrance. FIG. 1 discloses goal assembly 1 having an entrance generally circumscribed by frame components (tubing) 2*a*, 2*b* and 3. The goal frame includes components 2*a*, 2*b*, 3, 7*a*, 7*b* and 8. A net 6 is attached to the frame's components such that a ball or puck passing through the goal's entrance will be retained by the net.

In the frame of goal assembly 1, vertical components 2*a* and 2*b* define the height of the goal's entrance, and horizontal component 3 delimits the width of the entrance. According to the present invention, components 2*a* and 2*b* are adjustable in the vertical direction depicted by arrow 4 to permit the height of the goal's entrance to be varied. Component 3 is adjustable in the horizontal direction, depicted by arrow 5, to permit the width of the entrance to be varied.

The frame can be made to provide a setting which corresponds to the regulation or customary goal entrance size of the sport or game for which the assembly is intended. For instance, in the case of hockey, the horizontal component 3 can include a setting which provides an internal width of 6 feet for the entrance, and the vertical components 2*a* and 2*b* can be adjustable to provide an internal height of 4 feet for the entrance. In the case of roller and street hockey, the height and width dimensions would generally be substantially less. In accordance with the structure illustrated in FIG. 1, the frame is adjustable to settings which are much less than regulation parameters. This is to provide an assembly which is stable as well as light and portable. We have found that suitable dimensions for the height and width are approximately 23.5 inches and 21.0 inches, respectively. Such dimensions are useful for 1-on-1 to 3-on-3 competition in roller and street hockey.

Vertical components 2*a* and 2*b*, and horizontal component 3, can be made adjustable in a variety of ways.

Figure 2:
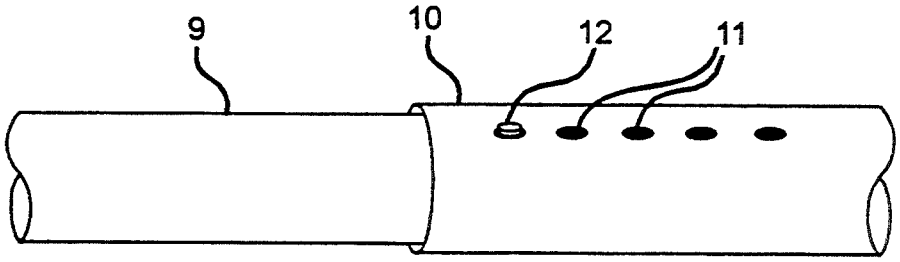
FIG. 2 is a close-up perspective view of telescoping components of the frame disclosed in FIG. 1.

FIG. 2 illustrates one means of making the vertical and horizontal front components adjustable. In FIG. 2, the vertical or horizontal component consists of two pipes, 9 and 10. Pipe 9 fits within the inner diameter of pipe 10. Pipe 9 includes a depressable button 12 which, in its depressed state, permits pipe 9 to slide within pipe 10. Pipe 10 includes several regularly-placed holes 11 along the length of the pipe. To secure pipe 9 within pipe 10, button 12 is aligned with a hole 11 so that the button automatically springs or extends within the hole. To adjust to another setting, button 12 is again depressed and pipe 9 is adjusted until button 12 is aligned with another hole 11. In addition to a depressable button, a screw or other means can be used to secure pipe 9 within pipe 10 at various positions designated by holes 11.

Figure 3:
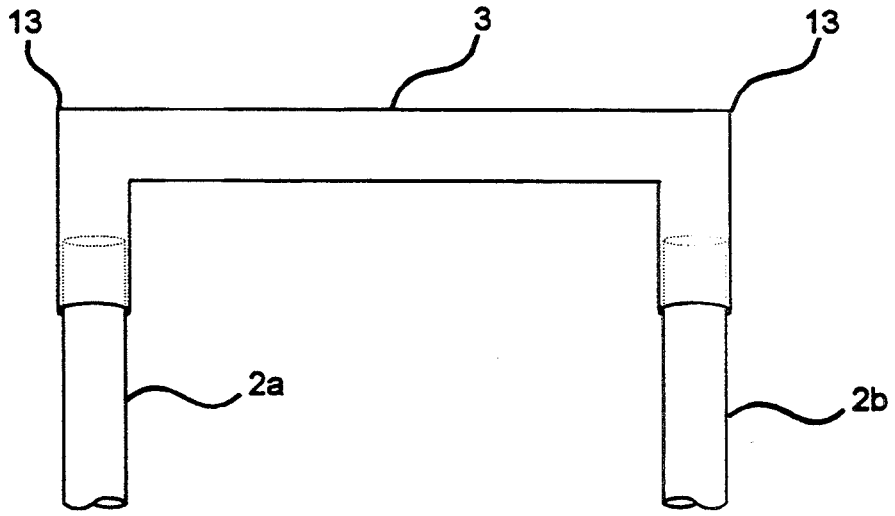
FIG. 3 is a view of the vertical and horizontal front components fitted together.

The vertical and horizontal components can also be made adjustable by simply using pipes of different lengths. FIG. 3 illustrates horizontal component 3 coupled at each end with vertical components 2*a* and 2*b*. Component 3 includes coupling turns 13 which fit easily over the ends of components 2*a* and 2*b*. Alternatively, coupling turns 13 can fit within the ends of components 2*a* and 2*b*. Preferably component 3 is secured to components 2*a* and 2*b* but is also easily removed from components 2*a* and 2*b*. Component 3 becomes adjustable by simply replacing it with another horizontal bar of different length which would also include coupling turns 13 to secure the bar to components 2*a* and 2*b*. Thus, under the present invention, the term "adjustable", or other similar term, used in reference to the vertical and horizontal components of the goal's entrance encompasses replacing frame components of one size with components of another size or dimension.

The goal frame of the present invention includes a rear stability device which rests against the playing surface. In FIG. 1, the rear stability device includes components 7*a*, 7*b* and 8. The rear stability device generally includes any construction which stabilizes the position of the goal's entrance while the game is played or practiced. As illustrated, components 7*a* and 7*b* are coupled with components 2*a* and 2*b*, respectively. Components 7*a* and 7*b* converge and couple with component 8. The net 6 covers the rear of the goal and is secured to the various components.

Figure 4:
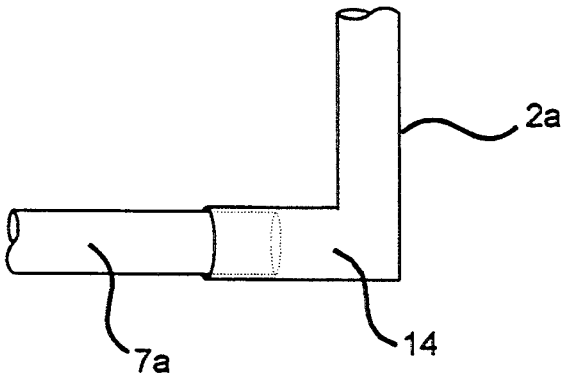
FIG. 4 is a view of a vertical front component fitted with a rear stabilizing component.

In FIG. 1, components 7*a* and 7*b* are coupled with the vertical components by any suitable means. While the vertical component 2*a* and component 7*a* can consist of a single molded piece, it is preferred that the two components are detachable. FIG. 4 illustrates an embodiment in which vertical component 2*a* includes coupling turn 14 which fits over the outer diameter of component 7*a* which is secured by the friction between the surfaces of each component. The embodiment illustrated in FIG. 4 can also be used to secure components 2*b* and 7*b*.

Figure 5:
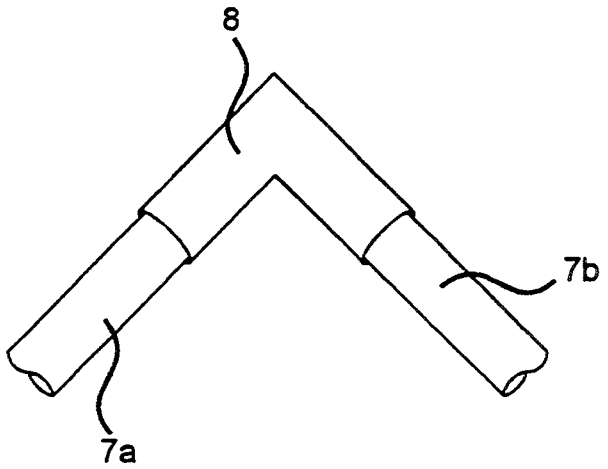
FIG. 5 is a close-up view of flexible tubing connecting rear stabilizing components.

Components 7*a* and 7*b* converge at coupling component 8. Component 8 includes any flexible structure which will allow the angle defined by components 7*a* and 7*b* to increase or lessen as the width of the goal's entrance is correspondingly increased or lessened. FIG. 5 provides a closer view of component 8 as illustrated in FIG. 1. As shown, component 8 is a flexible rubber or plastic tube which can fit over the ends of components 7*a* and 7*b*.

Figure 6:
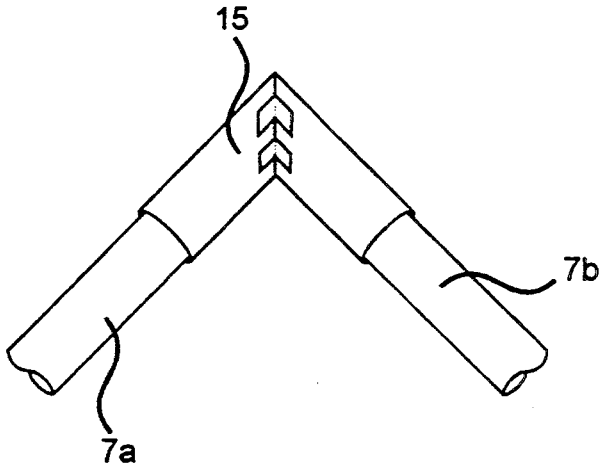
FIG. 6 is a view of a hinge connecting the rear stabilizing components.

An alternative coupling arrangement is illustrated in FIG. 6 which shows a plastic hinge 15 which is connected to the ends of components 7*a* and 7*b*. The plastic hinge permits the angle defined by components 7*a* and 7*b* to vary as necessary. Like a flexible rubber or plastic tube, the plastic hinge permits components 7*a* and 7*b* to be collapsed together when the goal assembly is folded for storage.

Figure 7:
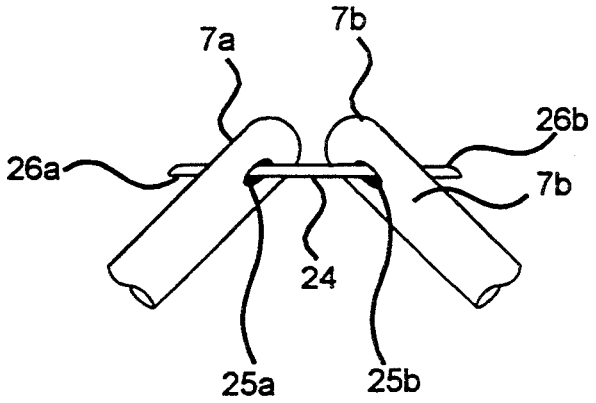
FIG. 7 is a view of an alternative hinge connecting the rear stabilizing components.

Another coupling arrangement is illustrated in FIG. 7 which shows a rigid tube 24 passed through the ends of components 7*a* and 7*b*. The bar or tube 24 passes through holes 25*a* and 25*b* which are sufficiently large to permit the angle defined by components 7*a* and 7*b* to vary over a considerable range. The components 7*a* and 7*b* are secured to the tube 24 by placing caps, washers or other restraining means on the ends 26*a* and 26*b* of the tube 24.

Figure 8:
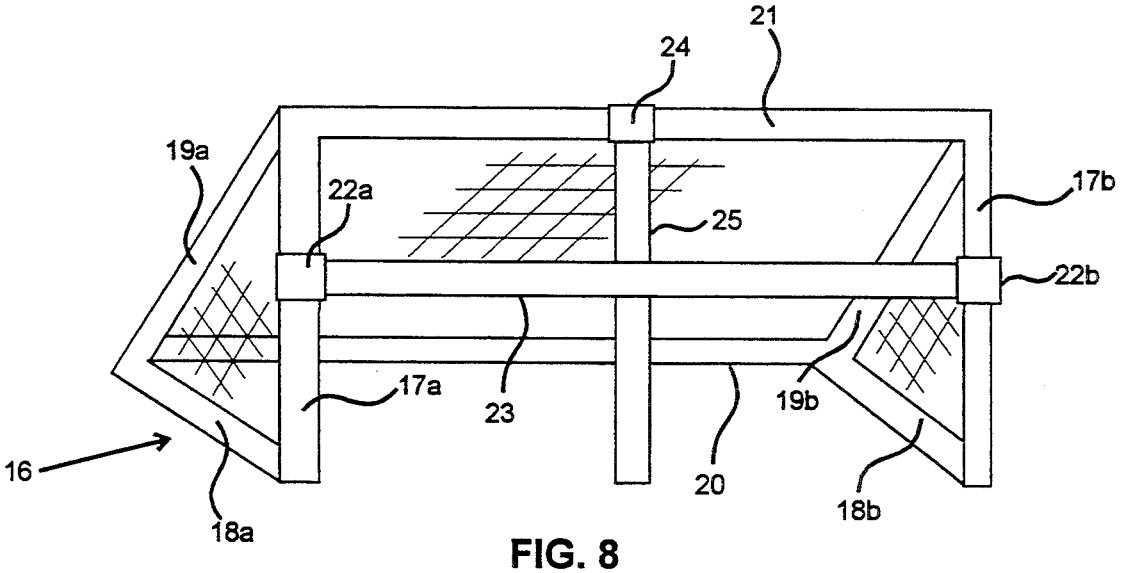
FIG. 8 is a perspective view of an alternative embodiment of the goal frame of the present invention.

FIG. 8 illustrates an alternative embodiment of the present invention. In FIG. 8, goal assembly 16 has an entrance which is circumscribed by horizontal component 21 and vertical components 17*a* and 17*b*. The rear stability device consists of components 18*a* and 18*b* which are coupled with components 19*a* and 19*b*, respectively. A bar 20 is provided to prevent the ball or puck from passing through the rear of the goal.

As illustrated, the goal is constructed to conform with regulation or customary dimensions. Within the goal's entrance, two adjustable members 23 and 25 are provided. The horizontal member 23 is coupled at one end 22*a* with vertical front component 17*a*, and at the other end 22*b* with vertical front component 17*b*. The ends 22*a* and 22*b* represent adjustable coupling means such as Velcro TM strips or plastic tubing which can be moved to different positions along vertical components 17*b* and 17*a*. The vertical member 25 is coupled in a similar fashion to horizontal front component 21 to permit member 25 to be adjusted to different positions along component 21. Alternatively, the cross-shaped component defined by members 23 and 25 can comprise one molded plastic unit to be placed in the goal's entrance. Small nets (not shown) could also be placed in each quadrant defined by cross members 23 and 25. Thus, as shown, the horizontal and vertical dimensions of the goal's entrance is adjustable without having to adjust other components of the frame and without sacrificing the stability of a fully constructed goal assembly. Thus, under the present invention, the term "adjustable", or other similar term, used in reference to the vertical and horizontal components of the goal's entrance, encompasses a frame which retains its original outer dimensions but has components within the frame's entrance which can be moved in the horizontal or vertical direction.

Of course, any suitable means of stabilizing the rear of the goal can be used in the present invention. The structure illustrated in FIG. 1 includes fewer components than the structure illustrated in FIG. 8. Thus, the structure of FIG. 1 would generally be less heavy than the structure of FIG. 8, and would be easier to assemble and collapse. Thus, the structure of FIG. 1 may be preferred for certain sports such as roller and street hockey.

The net 6 in FIG. 1 can be secured to the goal's frame by any suitable means. A preferred means is Velcro TM straps which are connected at various points on the edge of the net and which can be wrapped around the circumference of the various components. Velcro TM strips can also be placed on the various components and then connected with corresponding Velcro TM strips attached to the edge of the net. The net itself can be made of a nylon or similar material. The weave must be sufficiently tight to prevent a puck or ball from passing through.

The components making up the goal's frame can also be any suitable material. Materials ranging from wood to metal can be used. A hard plastic may be preferred because of its light weight and high durability. Polyvinyl chloride (PVC) tubing is particularly useful. Because PVC tubing is generally a lightweight material, it may be useful to weight components *7a* and *7b* (of FIG. 1) with sand to provide extra stability to the goal assembly. The remaining components should not be weighted to keep the overall weight of the goal assembly to a minimum.

What is claimed is:

1. A frame for a goal assembly, said assembly comprising the frame and a net attached to the frame, the frame comprising two parallel vertical front components, each vertical front component being adjustable in the vertical direction to provide a plurality of heights for the frame, a horizontal front component coupled at one end with one vertical front component and coupled at the other end with the other vertical front component, said horizontal front component being adjustable in the horizontal direction to provide a plurality of widths for the frame, and a rear stability device for maintaining the vertical front components in a direction substantially perpendicular to a surface on which the frame is placed, said rear stability device comprising two rear members which rest on the surface on which the frame is placed, each rear member having front and back ends, wherein the front end of one member is coupled with one vertical front component and the front end of the other member is coupled with the other vertical front component, and the back ends of each rear member converge to a flexible connection such that the angle defined by said converging members can vary to accomodate different widths of the horizontal front component.

2. The frame of claim 1 wherein said flexible connection comprises flexible tubing which is coupled to the back end of each rear member.

3. The frame of claim 1 wherein said flexible connection comprises a hinge.

4. The frame of claim 3 wherein said hinge comprises a bar which passes through an aperture in the back end of each rear member.

5. The frame of claim 1 wherein said horizontal component comprises at least two horizontal members of different lengths wherein said horizontal component is adjustable through replacement of a horizontal member of one length with a horizontal member of another length.

6. The frame of claim 1 wherein said horizontal component comprises inner and outer members, said inner member telescoping within said outer member to provide said plurality of widths for the horizontal component.

7. The frame of claim 1 wherein the frame is adapted for a goal assembly intended for street hockey.

8. The frame of claim 1 wherein said vertical front components and said horizontal front component are manufactured from polyvinyl chloride tubing.

9. The frame of claim 1 wherein said horizontal front component is adapted to comprise a width of about 21 inches and said vertical front components are adapted to comprise a height of about 23.5 inches.

* * * * *